United States Patent [19]

Khan

[11] Patent Number: 5,062,349

[45] Date of Patent: Nov. 5, 1991

[54] FLUID ECONOMIZER CONTROL VALVE SYSTEM FOR BLOWOUT PREVENTERS

[75] Inventor: Farooq A. Khan, Yorba Linda, Calif.

[73] Assignee: Baroid Technology, Inc., Houston, Tex.

[21] Appl. No.: 495,490

[22] Filed: Mar. 19, 1990

[51] Int. Cl.[5] ..... F15B 11/16

[52] U.S. Cl. ..... 91/436; 137/625.66

[58] Field of Search ..... 91/436; 137/625.66

[56] References Cited

U.S. PATENT DOCUMENTS

| | | | |
|---|---|---|---|
| 3,036,807 | 5/1962 | Lucky et al. | 251/28 |
| 3,168,010 | 2/1965 | Thomas | 91/436 X |
| 3,299,957 | 1/1967 | O'Neill et al. | 251/28 |
| 3,403,601 | 10/1968 | Eddy | 91/436 X |
| 3,654,835 | 4/1972 | Sievenpiper | 91/436 |
| 3,795,177 | 3/1974 | Cryder et al. | 91/436 X |
| 4,614,148 | 9/1986 | Bates | 91/436 X |

*Primary Examiner*—John C. Fox

*Attorney, Agent, or Firm*—Browning, Bushman, Anderson & Brookhart

[57] ABSTRACT

A flow pressure sensing control valve system is disclosed for use with blowout preventers having an operator cylinder and piston for closing of the blowout preventer, wherein the operator cylinder and piston have a closing side and an opening side and wherein the closing side has a greater effective surface area than the opening side. The system includes a sensing means for dropping pressure of flow directed to the closing side relatively with increases in the flow velocity of the fluid flow. A fluid return system is included for selectively directing the fluid from the opening side of the operator piston to the closing side of the operator piston when the drop in pressure across the sensing means attains a magnitude above a predetermined value in order to reduce fluid capacity requirements and alternatively to direct flow from the closing side to a discharge point when the drop in pressure decreases below the predetermined value. A sequence valve for selectively initiating the flow to the sensing means for use in combination with the sensing means and fluid return system is also disclosed.

10 Claims, 4 Drawing Sheets

FLUID ECONOMIZER CONTROL VALVE SYSTEM FOR BLOWOUT PREVENTERS

BACKGROUND OF THE INVENTION

1. Field of the Invention

The invention relates generally to control valve systems and, more particularly, it concerns a control valve system for opening and closing blowout preventers.

2. Description of the Prior Art

Two major classes of blowout preventers—spherical and ram-type—are currently utilized to shut off uncontrolled flow of pressurized fluid in oil and gas wells. In operation, a spherical blowout preventer uses a working fluid which is injected on the closing side of a built-in piston to force the piston against a deformable closure element, thereby expanding the element into the flow path of the line fluid to cut off flow. The ram-type blowout preventer includes a hydraulic cylinder having a rod attached to its piston and a ram connected to the rod which acts as the closure element to close the passage of pressurized fluid. For simplicity, this application will focus on ram-type blowout preventers. It should be apparent to those skilled in the art, however, that this discussion could equally apply to spherical blowout preventers in its advantageous features.

Operator cylinders having a closed cylinder with a piston slidably mounted therein, and a rod secured to the piston and extending out of one end of the cylinder, have long been utilized as operators for blowout preventers. These types of preventers may be characterized as having a blind side of the piston and a rod side of the piston as designated by the location of the rod.

Typically, such an operator cylinder functions by injecting fluid into the cylinder on the blind side in order to move the rod to an extended position such that the rod moves the blowout preventer closure means to close off flow from the well. During the movement of the piston and rod, fluid contained on the rod side is discharged to a reservoir.

This filling of one side with new fluid and emptying the second side of old fluid demands great volumes of fluid to move the piston and rod from a fully opened position to a fully closed position. Horsepower requirements to close the piston are also significant due to the volumetric relationship between flow through the pump and the pressure of the lines. That is, the greater the volume of flow at a given pressure, the greater the installed horsepower requirements.

Many attempts have been made to reduce the horsepower and fluid requirements of an operator cylinder. In U.S. Pat. No. 3,036,807 to Lucky, a valve apparatus is provided which utilizes the downhole pressure of the line fluid created by the blowout to aid in closing the blowout preventer. The use of line fluid, however, can increase both corrosion and contamination of the valve parts, thereby shortening the useful life of the valve.

In U.S. Pat. No. 3,299,957 to O'Neil, a system is shown in FIG. 18 comprising an accumulator cylinder utilized in conjunction with a pump means. The pump means is continuously operated to effectively raise the piston and pressurize the accumulator cylinder. The system, however, allows the use of a lower horsepower input pump rather than minimizing overall horsepower requirements and fluid requirements. As in many of the other prior art devices, fluid expelled from the pistons during the lowering motion of the pistons is discharged to a reservoir each time the pistons are lowered.

Other attempts are believed to have been made to reduce the overall horsepower requirements, but these are believed to have involved costly modifications to the blowout preventer structure.

Hence, to provide an improved control valve system, it is desirable to provide a system requiring less horsepower to operate the system, while also decreasing hydraulic fluid requirements of the system.

SUMMARY OF THE INVENTION

The present invention overcomes the prior art disadvantages through a control valve system for blowout preventers which includes a sensing means for dropping pressure relative to increases in the flow velocity of fluid to the blind side (hereinafter sometimes referred to generically as the closing side) of the piston and a fluid return system for monitoring the drop in pressure in order to selectively direct fluid from the rod (hereinafter sometimes referred to generically as the opening side) of the operator cylinder to the blind side of the operator cylinder. It should be understood that the control valve system is equally applicable to spherical blowout preventers wherein the closing side of the piston in the spherical blowout preventer corresponds to the blind side of the operator piston of a ram-type preventer and the opening side corresponds to the rod side and wherein the effective surface area of the closing side is greater than the effective surface area of the opening side. As stated above, however, for simplicity, the invention will be described in detail for a ram-type blowout preventer. The terms, operator cylinder and operator piston will be utilized, though, to designate the generic concept of both a ram-type preventer and a spherical blowout preventer.

Accordingly, the present invention overcomes the prior art disadvantages through a control valve system for operator cylinders having an operator piston member slidably mounted therein. The cylinder has an opening side corresponding to the end of the cylinder in which fluid enters when opening the blowout preventer and a closing side corresponding to the side in which fluid enters to close the blowout preventer. The control valve system includes a sensing means for dropping the pressure of fluid directed through it to the closing side relatively with increases in flow velocity and a fluid return system for selectively directing fluid from the opening side of the operator cylinder to the closing side of the operator cylinder when the drop in pressure across the sensing means attains a magnitude above a predetermined value. This transfer of fluid from the opening side to the closing side reduces fluid capacity requirements and installed horsepower requirements by reducing the volume of fluid which must pass through the pump to close the blowout preventer.

In the preferred embodiment, the sensing means typically includes a flow dampener, but it will be understood that other pressure varying, velocity dependent devices may be utilized in accordance with the present invention.

In the preferred embodiment, the fluid return system also includes a directional flow control system for selectively directing flow from the opening side of the operator piston alternatively to either the closing side of the operator piston when the drop of pressure across the sensing means is above the selected value or to a discharge point when the drop is below the selected value.

A switching system is in communication with the directional flow control system and the sensing means for carrying the alternative flow paths of the directional flow control system for predetermined pressure values.

In a more detailed aspect of the preferred embodiment, the sensing means has a high side which communicates with a pressurized fluid source and a low side which communicates with the closing side of the operator cylinder. The directional flow control system then comprises a control cylinder including a control piston slidably mounted therein. The control cylinder has a retracting end which communicates with the pressurized fluid source, and a return end which communicates with a discharge point (typically a tank or reservoir). The control cylinder further communicates at a point along its length with the opening side of the operator cylinder so that movement of the control piston between the return end and the retracting end of the control cylinder places the opening side of the operator cylinder in communication with either the closing side of the operator cylinder via the sensing means or with the discharge point.

The directional flow control system of this aspect of the preferred embodiment further includes a switching mechanism for selectively moving the control piston. The switching mechanism may comprise a switching cylinder including a switching cylinder piston slidably mounted therein. A rod is then disposed in communication with the switching cylinder piston and the control piston such that the selective movement of the switching cylinder piston selectively displaces the switching rod, thereby displacing the control piston from one end of the control cylinder to the other.

In this aspect of the invention, the pressure differential across the sensing means is monitored with relation to the surface areas of the control piston and the switching cylinder piston. That is, the pressure is measured as a function of force on each piston as defined by the respective effective surface areas of the pistons wherein the pressure on the low side of the sensing means is directed to the switching cylinder while the high side pressure is applied to the control piston. Hence, by regulating the difference in surface areas between the switching cylinder piston and the control piston, the movement of the switching cylinder piston may be controlled for given pressure drops across the sensing means. In this manner, the switching cylinder piston operates to selectively displace the control piston to the desired mode.

In a more detailed aspect of the invention, the control valve system includes a sequence valve in communication with the control cylinder for selectively directing pressurized fluid to open the operator cylinder or to close the operator cylinder. The sequence valve may comprise a means for monitoring pressure input from a first variable pressurized fluid source and a means for selectively directing fluid flow from the first fluid source to a means for channeling fluid from a second fluid source to open or close the actuating cylinder.

The instant invention also provides a method of decreasing fluid capacity requirements and horsepower requirements for operator cylinders. The steps included in this method may include, first, injecting the fluid into the opening side of the operator cylinder in order to move the operator piston to an open position. Fluid is then selectively injected under pressure through the sensing means to the closing side of the operator piston in order to initiate movement of the operator piston to close the blowout preventer and in close to create a drop in pressure across the sensing means. When the magnitude of the drop in pressure is above a predetermined value, fluid is forced from the opening side of the operator piston to the closing side of the operator piston in order to conserve fluid. Once the magnitude of the drop in pressure across the sensing means drops below the predetermined value, the fluid forced from the opening side of the operator piston is then redirected to a reservoir.

Accordingly, the present invention overcomes the previously discussed problems of excessive fluid requirements and excessive installed horsepower requirements through a valve system which monitors the drop in pressure across a sensing means, in order to utilize the fluid contained in the operator cylinder on the opening side of the piston to fill the cylinder on a closing side of the piston.

BRIEF DESCRIPTION OF THE DRAWINGS

This invention will further be illustrated by reference to the appended drawings which illustrate particular embodiments of the control valve system in accordance with this invention.

DESCRIPTION OF THE PREFERRED EMBODIMENTS

This invention relates to an operator cylinder control valve system particularly suited for use with blowout preventers. While the description below will focus on a mechanical control valve system for a ram-type blowout preventer, it will be understood that the present invention is also applicable to spherical blowout preventers and to systems including electromechanical switching mechanisms.

Figure 1:
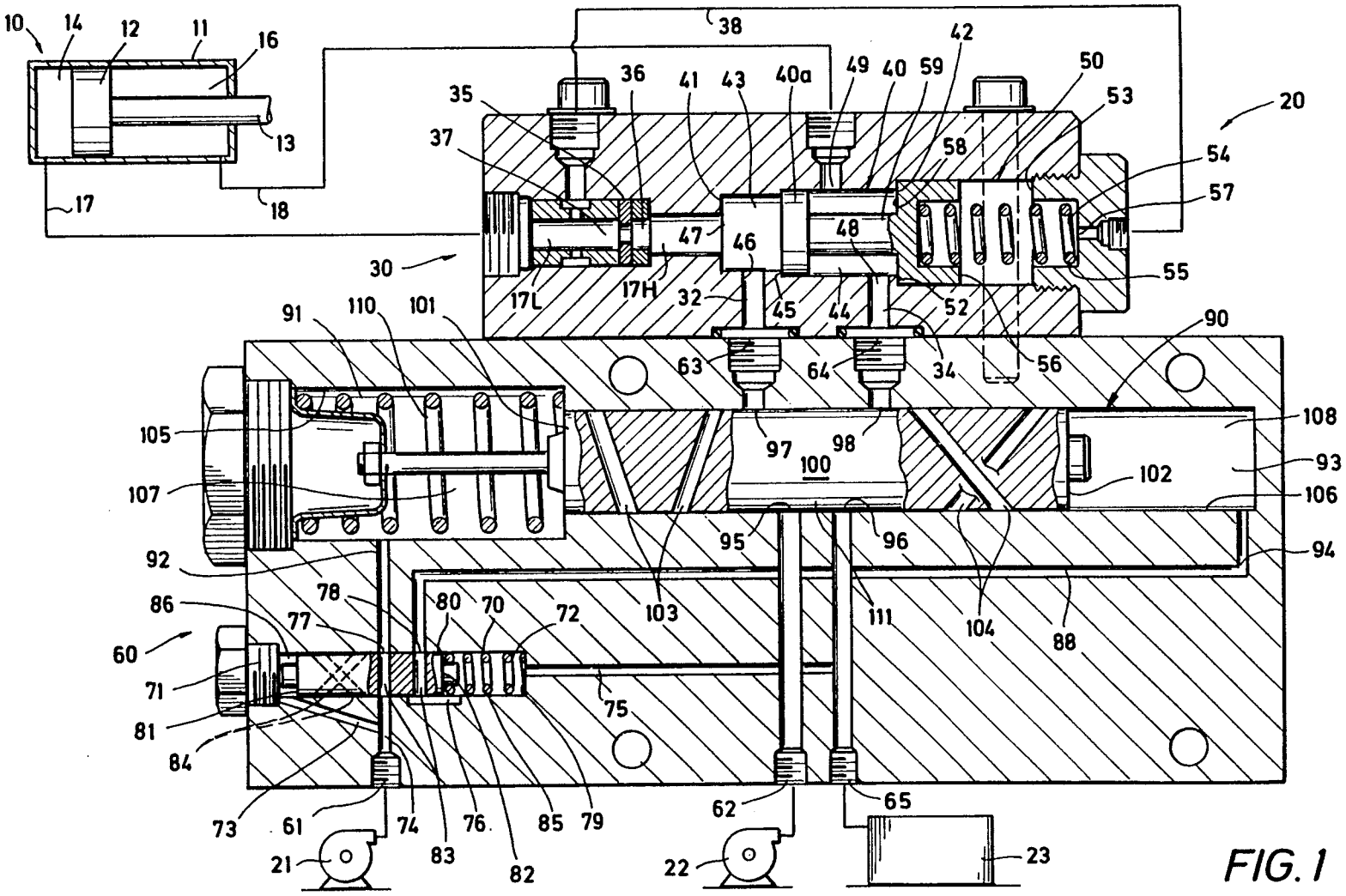
FIG. 1 is a schematic, cross-sectional view of the control valve system for operator cylinders.

Referring to FIG. 1, the blowout preventer system 10 is represented by an operator cylinder 11 having an operator piston 12 to which is secured a rod 13. The operator piston 12 and operator cylinder 11 have a closing side 14 opposing the side on which the rod 13 is connected and an opening side 16 corresponding to the side of the operator piston 12 to which the rod 13 is connected. The operator cylinder 11 further communicates on the closing side 14 with a closing side line 17 and on the opening side 16 with an opening side line 18.

The control valve system 20 is generally represented by a fluid economizer valve 30 which is in communication with the sequence valve 60 such that a signal from the sequence valve 60 commences the operation of the fluid economizer valve 30. In the preferred embodiment, the communication between the fluid economizer valve 30 and the sequence valve 60 is provided by a closing mode line 32 and an opening mode line 34.

The sequence valve 60 is, in turn, in communication with a variable pressurized fluid source 21, a constant pressurized fluid source 22 and a reservoir or tank 23, which acts as a discharge point for the fluid of the system. In the preferred embodiment, the pressure sources 21 and 22 may comprise fluid pumps and pressure regulators together with one or more accumulators. Other suitable pressure supply means, however, may be utilized in accordance with this invention. In turn, reservoir 23 may be the fluid tank utilized in conjunction with the pressure pump or any other suitable tank for storing or recycling the working fluid.

The fluid economizer valve 30 comprises a sensing means 35 in communication with the closing mode line 32, a control cylinder 40, and a switching cylinder 50.

The sensing means 35 may comprise any suitable structure which creates a drop in pressure dependent upon the velocity of flow through it, such that at low velocities the drop in pressure approaches zero and at high velocities the drop increases to a preselected range. In the preferred embodiment, the sensing means 35 comprises a flow diaphragm 35 which creates a drop in pressure of approximately thirty psi at maximum velocity. Other suitable sensing means or diaphragms, however, creating different maximum drops in pressure may be utilized in accordance with this invention.

The sensing means or, in the preferred embodiment, flow diaphragm 35 further has a high side 36 and a low side 37. The diaphragm 35 communicates on the high side 36 directly with the control cylinder 40 and with flow from the opening side line 18 via the control cylinder 40 and closing side line 17H. The diaphragm 35 further communicates on the low side 37 with the closing side line 17L and with a pressure monitor line 38.

The control cylinder 40 serves to selectively route flow from the opening side 16 of the operator cylinder 11 to the closing side 14 of the operator cylinder 11. In the preferred embodiment, the control cylinder 40 has a retracting end 41 adjacent the flow dampener 35 and a return end 42 at the opposing end. The control cylinder 40 further has two cylindrical subparts, a feed cylinder 43 located adjacent to the retracting end 41 and a bypass cylinder 44 of larger diameter than the feed cylinder located adjacent the return end 42. The feed cylinder and bypass cylinder are concentrically aligned and have constant diameters of different magnitude respectively.

The feed cylinder 43 and bypass cylinder 44 communicate with each other such that they form a perpendicular annular face 45 which comprises a thin annular ring of width equal to the difference between the two diameters. The feed cylinder 43 further has an input aperture 46, to which closing mode line 32 is connected and a diaphragm aperture 47 located in the retracting end 41 and communicating with closing side line 17H.

The bypass cylinder 44 has a drain aperture 48 in communication with opening mode line 34, and a mid-aperture 49 located along its length and in communication with opening side line 18.

The bypass cylinder 44 further comprises a control piston 40*a* slidably mounted therein. The piston 40*a* has a width such that its movement between the annular face 45 near the retracting end 41 and the return end 42 directs flow from the opening side line 18 either to the drain aperture 48 or to the diaphragm aperture 47.

The piston 40*a* further has an outer diameter slightly less than the inner diameter of the bypass cylinder 44 such that the control piston 40*a* snugly fits bypass cylinder 44 and precludes or minimizes flow around the piston 40*a*. Additionally, the side of control piston 40*a* nearest the retracting end 41 further has a face parallel to the annular shoulder 45 such that movement of the piston 40*a* toward the return end brings the piston 40*a* into substantially flush contact with the annular shoulder 45. In this manner, the annular shoulder 45 reduces the effective surface area of the piston 40*a* subject to fluid pressure and acts as a detent for the piston 40*a* for pressures for which the force exerted on the reduced surface area is less than the resistant force seen on the opposing side of the control piston 40*a* from pressurized flow on the other side or from the switching rod 59 as described below.

The switching cylinder 50 has an open end 58 adjacent the control cylinder 40 and a closed end 53 opposing the open end 58. The switching cylinder 50 is concentrically aligned with the control cylinder 40 and has a slightly greater diameter than the control cylinder 40. The switching cylinder 50 further comprises an annular shoulder 52 having a width defined by the difference in diameters between the control cylinder 40 and the switching cylinder 50, wherein the annular shoulder 52 partially closes the open end 58 which is connected to control cylinder 40.

In the preferred embodiment, the closed end 53 of switching cylinder 50 includes a recessed portion 54 and a biasing spring 55 mounted therein. The biasing spring 55 is, in turn, connected to a switching cylinder piston 56 and has a length and spring constant such that the piston 56 is slightly biased toward the open end 58. The closed end 53 further has a switching aperture 57 which communicates with the low side 37 of the diaphragm 35 by means of a pressure monitor line 38 in order to accommodate the monitoring of the drop in pressure across the diaphragm 35 as described below.

The switching cylinder 50 also comprises a switching cylinder piston 56 which is slidably mounted within the switching cylinder 50 for longitudinal movement. The piston 56 may include a recessed portion on the side corresponding to the closed end 53 such that the biasing spring 55 extends into and is secured to the switching cylinder piston 56. The switching cylinder piston 56 has an outer diameter slightly less than the inner diameter of switching cylinder 50 such that the switching cylinder piston 56 snugly fits within the switching cylinder 50 and prevents or minimizes flow of fluid around the switching cylinder piston 56.

A switching rod 59 is located between control piston 40*a* and switching cylinder piston 56. The rod 59 has a length such that movement of the control piston 40*a* between the annular face 45 and the return end 42 to permit fluid flow as described above is accommodated upon movement of the switching piston 56 between the two ends of the switching cylinder 50. The rod may be connected to either the control piston 40*a* or the switching cylinder piston 56, or it may be supported between the two via other suitable means. The outer diameter of the rod 59 is sufficiently less than the inner diameter of bypass cylinder 44 so that flow around the rod 59 is allowed.

Figure 4:
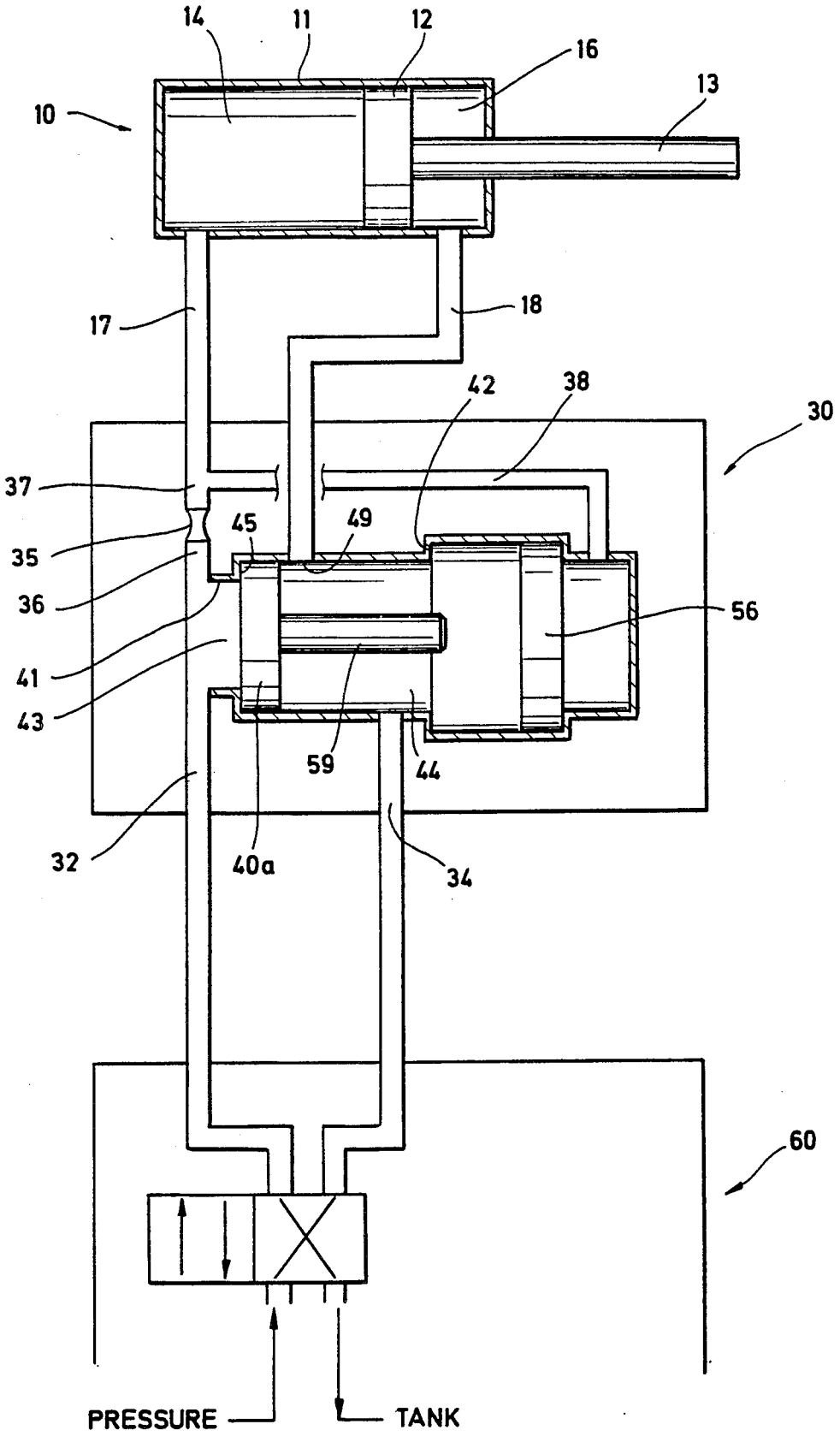
FIG. 4 is a schematic view of the control valve system of FIG. 1 in the opening mode wherein the operator piston is returned to a fully opened position.

Accordingly, when the fluid economizer valve is utilized, flow of pressurized fluid is first directed into the opening mode line 34 thereby forcing the control piston 40*a* to the annular face 45 near the retracting end 41 which in turn directs flow through the opening side line 18 into the opening side 16 of the operator cylinder 11 as shown in FIG. 4. This positions the operator piston 12 in the fully open position with the piston 12 residing near the closed end of the actuating cylinder 11.

Figure 2:
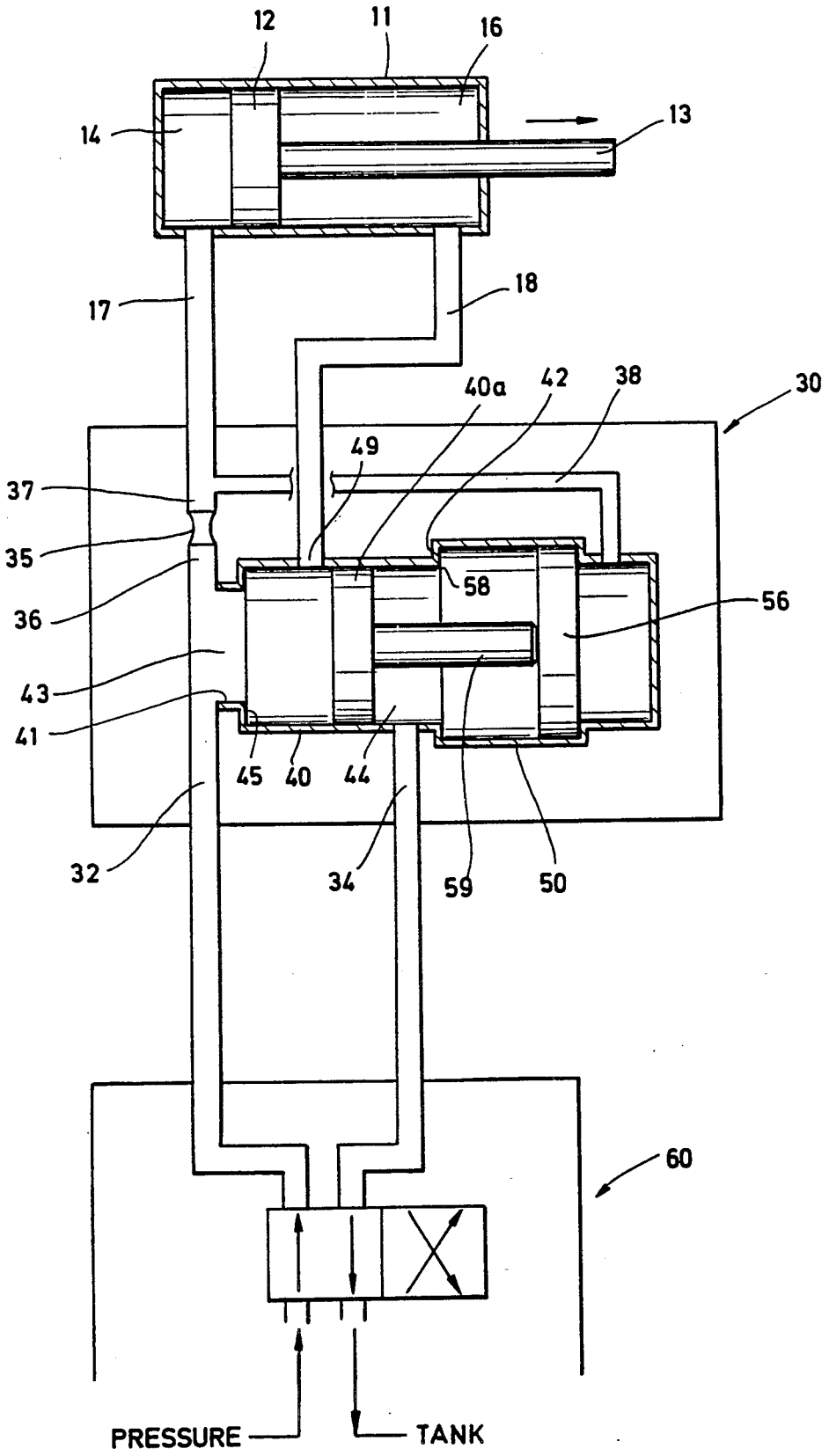
FIG. 2 is a schematic view of the system in FIG. 1 in the closing mode for fast motion and low force.

Referring to FIGS. 1 and 2, when it is desired to close the blowout preventer, flow is directed into the closing mode line 32 and into the feed cylinder 43 of the control cylinder 40. The pressurized flow, in turn, forces the control piston 40*a* and the switching cylinder piston 56 toward their return end 42 and closed end 53 respectively. The flow continues from the feed cylinder 43 through the diaphragm aperture 47, the closing side line 17H, the diaphragm 35, and through the closing side line 17L into the closing side 14 of the operator cylinder 11. Flow through the diaphragm 35 also continues from the low side 37 through the pressure monitor line 38 wherein it travels to the switching cylinder 50. Fluid also tends to travel through the bypass cylinder 44 to the opening side 16 of the operator 11 once the control piston 40*a* has moved toward the return end 42.

It should be noticed that the pressure seen by the switching cylinder piston 56 will be less than the pressure on the control cylinder 40*a* due to the drop in pressure across the diaphragm 35. Accordingly, the difference between the surface area of the switching cylinder piston 56 seen by pressurized fluid on low side 37 of the diaphragm 35 and the surface area of the control cylinder 40*a* piston seen by the pressurized fluid on the high side 36 of the diaphragm 35 should be such that the difference in pressure for high velocity flow is great enough to initially preclude movement of the switching cylinder piston 56 toward the open end 58 of the switching cylinder 50.

Also, because of the operator piston rod 13, the force exerted against the operator piston 12 on the opening side 16 will be less than the force exerted from the closing side 14 if equal pressure is seen on both sides. Because of the drop in pressure across the diaphragm 35, however, it is important to select a diaphragm or other sensing means causing a small enough pressure drop such that the drop in pressure will not cause the force on the operator piston 12 on the closing side 14 to be less than that exerted on the opening side 16. As stated above, the selected value for the drop in pressure at the outset is typically thirty pounds in the preferred embodiment. As will be understood by those skilled in the art, however, the selected value or range of values is critical only to the extent that a sensing means creating a drop in pressure within a range permitting movement of the operator cylinder to close must be utilized.

Given the proper drop in pressure across the diaphragm 35, operator piston 12 will then move from the closing side 14 to the opening side 16 of the operator cylinder 11 thereby forcing fluid contained within the operator cylinder 11 on the opening side 16 to be expelled through opening line 18 through the bypass cylinder 44, through the feed cylinder 43 and ultimately back into the closing side 14 of the operator cylinder 11. In this manner, the capacity of fluid required to close the actuating cylinder 11 is decreased.

Figure 3:
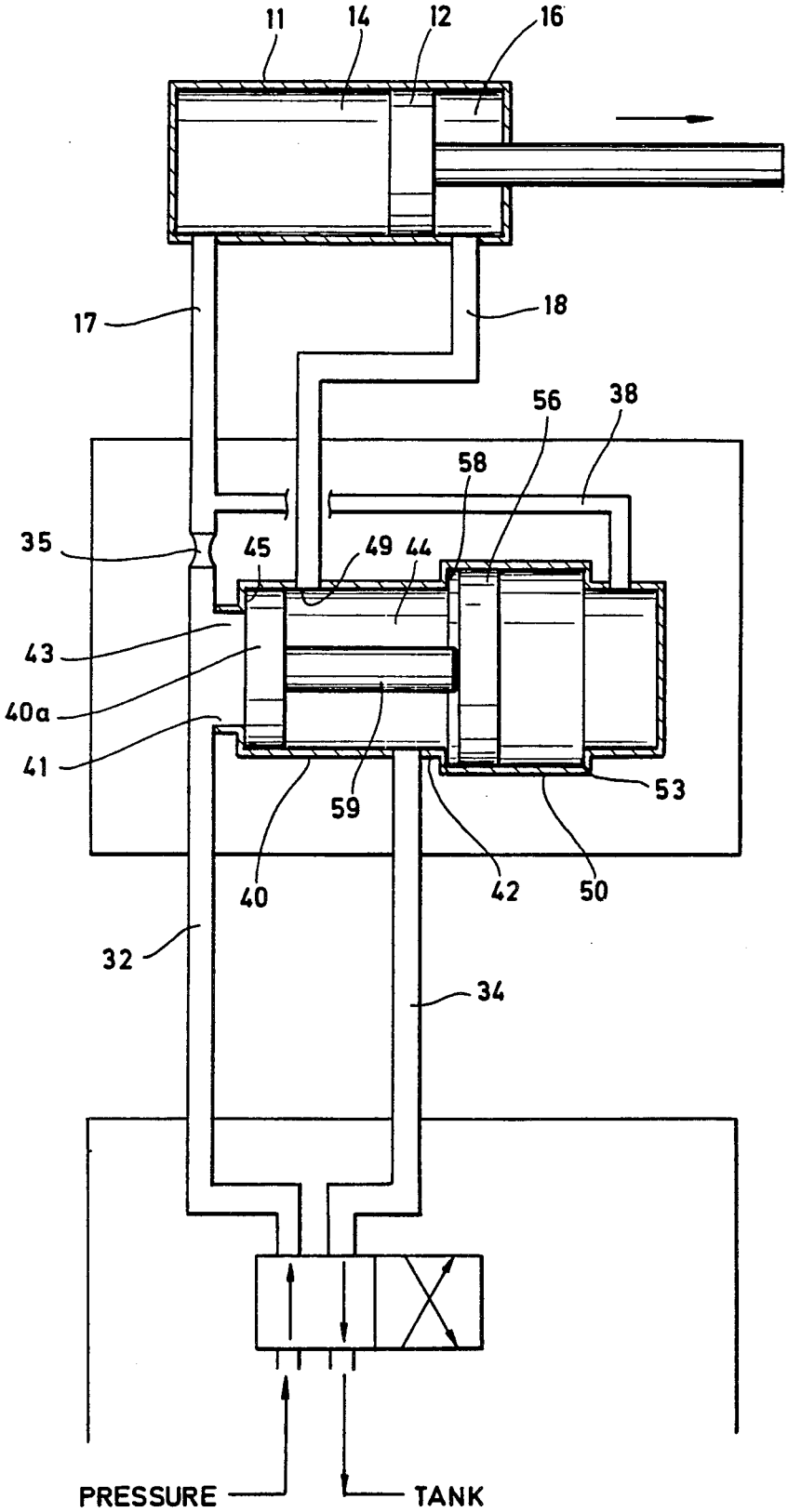
FIG. 3 is a schematic of the system of FIG. 1 in the closing mode once the pressure drop across the sensing means has decreased below the predetermined value.

As the operator cylinder 12 approaches the opening side 16 of the operator cylinder 11, the resistance on the operator rod 13 increases, thereby slowing the rate of closing and the rate at which fluid flows into the operator cylinder 16. The velocity of flow through the diaphragm 35 therefore decreases, lessening the drop in pressure across the diaphragm 35. Referring to FIG. 3, the decrease in the drop in pressure across the diaphragm 35 increases the pressure on the switching piston 56 relative to that on the control piston 40*a* such that the force on switching piston 56 exceeds the force on control piston 40*a*. The switching piston 56 therefore moves from the closed end 53 to the opened end 58, forcing the control cylinder 40*a* from the return end 42 toward the retracting end 41. The movement of the two pistons redirects flow from the opening side 16 of the operator cylinder 11 through the opening mode line 34 to a discharge point. As a result, the back pressure on the operator cylinder 12 is decreased, thereby allowing it to fully close.

Referring again to FIG. 1, the sequence valve 60 includes a means for monitoring pressure input from a first variable pressure fluid source 21, a means for selectively directing fluid flow from the first fluid source 21 to a means for channeling flow from a second pressurized fluid source 22 in response to the pressure input, and a means for selectively channeling fluid flow from the second pressurized fluid source to open or close the operator cylinder 11, the channeling means communicating with the flow dampener 35, the fluid return system, and the selective directing means.

In the preferred embodiment, the sequence valve 60 includes a housing having a first pressure inlet 61 in communication with the first pressurized fluid source 21, a second pressure inlet 62 in communication with the second pressurized fluid source 22, a closing mode outlet 63 in communication with the flow dampener 35 via the closing mode line 32, an opening mode outlet 64 in communication with the control cylinder 40 via the opening mode line 34, and a tank aperture 65.

The means for selectively directing fluid flow from the first fluid source 21 performs the function of directing the hydraulic signal to a mode selector cylinder 90 to move a piston in the cylinder 90 to a desired mode for either opening or closing the operator cylinder 11. In the preferred embodiment, the directing means comprises a flow selector cylinder 70 having a first end 71 and a second end 72. The first end 71 includes a chamber 86 in communication with a chamber branch line 73 which, in turn, communicates with the first pressurized fluid source 21. The flow selector cylinder 70 further communicates at a point along its length with the first pressure inlet 61 via a pressure feed line 74.

The flow selector cylinder 70 also has a tank relief outlet 79 positioned at the second end 72, a first pressure outlet 77 and a second pressure outlet 78 positioned along its length, and a pressure bypass line 76 in communication with a tank relief outlet 79. A flow selector tank line 75 is connected in communication with the tank relief outlet 79 and a tank 23.

A flow selector piston 80 is slidably mounted in the flow selector cylinder 70, the piston 80 having a first side 81 adjacent the first end 71 of the flow selector cylinder 70 and a second side 82 corresponding to the second end 72 of the flow selector cylinder 70. The piston 80 has an outer configuration having outer dimensions such that it snugly fits the inner dimensions of the flow selector cylinder 70 to minimize or preclude flow of fluid under pressure around the flow selector piston 80 from either side of the piston 80. The flow selector piston 80 also has a first pair of bores 83 and a second pair of bores 84 extending therethrough. The first pair of bores 83 has a position and orientation such that movement of the flow selector piston 80 to the first end 71 of the flow selector cylinder 70 aligns the first pressure outlet 77 in communication with the first pressure inlet 61 at the point along the length of the flow selector cylinder 70 in communication with the pressure feed line 74. At the same time, the pressure bypass 76 is aligned in communication with the second pressure outlet 78.

The movement of the flow selector piston 80 to the second end 72 of the flow selector cylinder 70 aligns the second pair of bores 84 such that the second pressure outlet 78 is placed in communication with the first pressure inlet 61 and pressure feed line 74 by one of the bores while the first pressure outlet 77 is placed in communication with the pressure bypass 76 by the other bore.

The means for monitoring pressure input from a first variable pressurized fluid source includes a means for pressure biasing the flow selector piston 80 toward the first end 71 of the flow selector cylinder 70. The means retains the piston in a biased position near the first end 71 of the flow selector cylinder 70 for pressures of fluid from the first pressurized fluid source 21 below a predetermined value. When the pressure of the fluid from the first pressurized fluid source 21 exceeds that value, however, the fluid will enter the branch line 73 and the chamber 86 and force the flow selector piston 80 to the second end 72 thereby redirecting flow.

In the preferred embodiment, the means for pressure biasing the flow selector piston 80 includes a flow selector bias spring 85 positioned between the flow selector piston 80 and the second end 72. The spring has a spring constant sufficient to prevent movement of the flow selector piston 80 toward the second end for pressurized fluid flow below a predetermined pressure. As will be understood, the exact value of this constant will depend upon the surface area of the flow selector piston 80 and upon the predetermined pressure value at which the piston 80 is desired to move. Also, while in the preferred embodiment, a biasing spring is utilized to monitor the pressure input, a pressure sensor and a solenoid or some other electrical or electromechanical system could be utilized in accordance with the present invention.

The flow selector cylinder 70 therefore selectively directs the flow of pressurized fluid to a channeling means described below, with the particular direction of flow depending upon the pressure of the flow.

The channeling means directs flow from a second pressurized fluid source 22, which in the preferred embodiment is an accumulator cylinder, to either the closing side 14 of the actuating cylinder 11 via the flow dampener 35 or to the opening side 16 of the actuating cylinder 11 via the fluid return system.

In the preferred embodiment, the channeling means comprises a mode selector cylinder 90 having a closing end 91 and an opening end 93. The cylinder 90 includes two aligned concentric cylindrical sections. The first cylindrical section 105 is disposed adjacent the closing end 91 and includes a first reservoir chamber 107. The second cylindrical section 106 is disposed adjacent the opening end 93 and has a second reservoir chamber 108. The first reservoir chamber 107 communicates with the first pressure outlet 77 of flow selector cylinder 70 through a first aperture 92 disposed along the side of the first cylindrical section 105. The second reservoir chamber 108 communicates with the second pressure outlet 78 via line 88 through a second aperture 94 disposed proximate the opening end 93.

The second cylindrical section 106 further has located along its length a pressurized source inlet 95 in communication with the second pressurized fluid source 22, a drain inlet 96 in communication with the tank 23, an operating outlet 97 communicating with the closing mode outlet 63 of the housing, and a preparatory outlet 98 communicating with the opening mode outlet 64.

A mode selector piston 100 is slidably mounted in the second cylindrical section 106 of the mode selector cylinder 90 for longitudinal movement, the piston having a closing side 101 corresponding to the closing end 91 of the mode selector cylinder 90 and an opening side 102 corresponding to the opening end 93. The piston 100 has outer dimensions substantially equal to the inner dimensions of the second cylindrical section 106 such that flow around the piston 100 is minimized or precluded. The piston 100 has a third pair of bores 103 positioned such that movement of the piston 100 to the opening end 93 aligns the pressurized source inlet 95 with the operation outlet 97 and the drain outlet 96 with the preparatory outlet 98. The selector piston 100 also includes a fourth pair of bores 104 positioned such that movement of the mode selector piston 100 to the closing end 91 of the mode selector cylinder 90 aligns the pressurized source inlet 95 with the preparatory outlet 98 and the drain outlet 96 with the operation outlet 97.

In this manner, movement of the mode selector piston 100 to the opening end 93 causes the pressurized fluid source to communicate with the closing end 14 of the operator cylinder 11 via the dampener 35 and causes the drain aperture 48 of the control cylinder 40 to communicate with the tank. On the other hand, movement of the mode selector piston 100 to the closing end 91 causes flow from the second pressurized fluid source 22 to be directed to the opening mode line 34 to open the operator cylinder 11 and flow from the closing side of the operator cylinder 11 to be discharged to tank.

The mode selector cylinder of the present invention may further include a mode spring 110 contained within the reservoir 107 and disposed to resist movement of the piston 100 toward the closing end 91 to bias the mode selector piston 100 in a desired mode when there is no signal from the flow selector cylinder 70. In the preferred embodiment, the mode selector piston 100 includes a neutral position 111 which blocks flow from the second pressurized fluid source 22 through the sequence valve 60. The bias spring 110, in turn, biases the mode selector piston 100 in the neutral mode 111 when there is no input from the flow selector cylinder 70.

Accordingly, when the sequence valve is utilized to open the operator cylinder 11, fluid under pressure greater than the preselected value (around 3,000 psi in the preferred embodiment) is injected from the first pressurized fluid source 21 through the first pressure inlet 61 into the chamber branch line 73 and the pressure feed line 74. The flow selector piston 80 is moved to the second end 72 of cylinder 70 thereby placing the second pair of bores 84 in alignment with the pressure feed line 74 and the pressure bypass 76. Flow from the first pressurized fluid source 21 is then directed via the opening line 88 to the opening end 93 of the mode selector cylinder 90. The mode selector piston 100 is therefore moved to align the fourth pair of bores 104 with the second pressurized fluid source 22 and the tank 23. Fluid is then channeled from the second pressurized fluid source into the opening mode line 34 and from the closing mode line 32 to tank to open the operator cylinder 11 as described above.

Once the operator cylinder 11 is opened, the flow of fluid from the first pressurized fluid source 21 is stopped, thereby causing the mode selector piston 100 to return to its biased position, the neutral mode 111. The control valve system should remain in this mode until the blowout preventer is to be actuated.

When it is desired to close the operator cylinder, such as upon the event of a blowout, flow from the pressurized fluid source 21 at a pressure less than that necessary to overcome the force exerted by the bias spring 85 is directed into the branch line 73 and the pressure feed line 74. Since the pressure and the fluid is not great enough to move the flow selector piston 80, flow from the first pressurized fluid source 21 proceeds directly through the first pressure outlet 77 and on into the closing end reservoir 107. This flow in turn moves the mode selector piston 100 to align the third pair of bores 103 with the pressurized source inlet 95 and the drain outlet 96. Flow from the second pressurized source 22 is then directed to the flow dampener 35 via the closing mode line 32 as described above. Additionally, the opening mode line 34 is placed in communication with the tank such that fluid from the closing side of the operator cylinder 11 may be drained to tank when the pressure across the dampener 35 is low enough as described above.

The instant invention has been disclosed in connection with specific embodiments. However, it will be apparent to those skilled in the art that variations for the illustrated embodiment may be taken without departing from the spirit and scope of the invention. For example, a pressure sensor could be located on the low side of the sensing means to sense the pressure variation and a solenoid could be placed in communication with the sensor to redirect flow from the opening side of the actuating cylinder when the pressure drop decreases below the predetermined value. These and other variations including electromechanical combinations should now be apparent to those skilled in the art and are within the spirit and scope of the invention.

What is claimed is:

1. A flow pressure sensing control valve system for use with blowout preventers having an operator piston and cylinder for opening and closing a blowout preventer, said piston and cylinder having a closing side and an opening side, said closing side having a greater effective surface area than said opening side, said system comprising:

a sensing means for creating a pressure drop in the flow directed to said closing side relatively with increases in flow velocity wherein said sensing means has a high side and a low side, said low side communicating with said closing side of said operator cylinder and said high side communicating with a pressurized fluid source; and a fluid return system, comprising, a directional flow control system for selectively directing flow from said opening side of said operator piston alternatively to said closing side of said operator piston when the drop in pressure across said sensing means is greater than a preselected value or to a discharge point when said pressure drop is less than said preselected value, said directional flow control system, comprising, a control cylinder having a bore with an inner diameter, a substantially open return end and a substantially closed retracting end, said retracting end being in communication with said pressurized fluid source and further having a retracting aperture proximate to said retracting end, a return aperture proximate to said return end and a mid-aperture located along the length of said control cylinder and in communication with said opening side of said actuating cylinder; and a control piston slidably mounted in said control cylinder for longitudinal movement, said piston having a configuration which snugly fits the inner diameter of said control cylinder and a longitudinal width which accommodates the communication of fluid from said opening side of said operator cylinder with said closing side of said operator cylinder when said control piston is at the return end of the flow routing cylinder and wherein discharge of fluid from said opening side of said operator cylinder is accommodated when said control piston is adjacent to said retracting end; and a pressure switching system in communication with said directional flow control system for selectively varying the alternative flow paths of said directional flow control system, said switching system, comprising, a switching cylinder having a discharge end in communication with said control cylinder, a feedback end in communication with said low side of said sensing means, and a longitudinal bore of diameter slightly greater than said inner diameter of said control cylinder;

a switching cylinder piston slidably mounted in said switching cylinder for longitudinal movement having an effective surface area slightly greater than the effective surface area of said control cylinder piston so that, upon closing of said operator cylinder, flow from said low side of said sensing means moves said switching cylinder piston to a discharge end when said pressure drop across said sensing means is below said preselected value and further having a configuration which snugly fits said inner diameter of said bore of said switching cylinder; and a switching rod positioned between said switching cylinder piston and said control piston, said rod having outer radial dimensions smaller than said inner diameter of said control cylinder and a location between said two pistons so that said switching rod can pass into said control cylinder to push said control piston to said retracted end upon movement of said switching cylinder piston to said discharge end and so that fluid may pass around said switching rod and through said control cylinder when said control piston is adjacent said retracting end of said control cylinder.

2. The control valve system of claim 1, wherein the switching system further comprises means for biasing the switching cylinder piston toward the discharge end, the biasing means exerting a bias force on the switching cylinder piston less than the difference between the force on the control piston upon initial entry of pressurized fluid upon closing and less than the force exerted on the switching cylinder piston by the pressurized fluid after passing through the sensing means while the pressure drop is above the selected value.

3. The control valve system of claim 2, wherein the switching cylinder has a recessed bore located at the feedback end having an inner diameter slightly less than the inner diameter of the switching cylinder and wherein said bias means comprises a spring positioned between the switching cylinder piston and the feedback end secured within and extending from the recessed bore.

4. The control valve system of claims 1 or 2 wherein the control cylinder further comprises a detent for the control piston in order to impede response of the control piston to pressure fluctuations of low magnitude when the control piston is adjacent to the retracting end.

5. The control valve system of claim 4 wherein the switching cylinder further comprises a detent for the switching cylinder piston in order to impede response of the switching cylinder piston to pressure fluctuations of low magnitude when the switching cylinder piston is positioned adjacent to the feedback end.

6. The control valve system of claim 5 wherein the switching cylinder comprises a second extended portion having a second recessed bore extending outwardly from the retracting end, the second bore having an inner diameter slightly less than the inner diameter of the switching cylinder and wherein the detent for the switching cylinder comprises an annular shoulder formed between the second recessed bore of second extended portion and the inner wall of the switching cylinder, the shoulder having a face which is substantially parallel to the switching cylinder piston when the piston is positioned adjacent to the shoulder.

7. The control valve system of claim 4 wherein the control cylinder comprises a first extended portion having a first recessed bore extending outwardly from the retracting end, the first bore having an inner diameter slightly less than the inner diameter of the control cylinder and wherein the detent for the control cylinder comprises an annular shoulder formed between the recessed bore of the first extended portion and the inner wall of the control cylinder, the shoulder having a face which is substantially parallel to the control piston when the piston is positioned adjacent to the shoulder.

8. The control valve system of claim 1 wherein the switching cylinder further comprises a detent for the switching cylinder piston in order to impede response of the switching cylinder piston to pressure fluctuations of low magnitude when the switching cylinder piston is positioned adjacent to the feedback end.

9. The control valve system of claim 8 wherein the switching cylinder comprises a second extended portion having a second recessed bore extending outwardly from the retracting end, the second bore having an inner diameter slightly less than the inner diameter of the switching cylinder and wherein the detent for the switching cylinder comprises an annular shoulder formed between the second recessed bore of second extended portion and the inner wall of the switching cylinder, the shoulder having a face which is substantially parallel to the switching cylinder piston when the piston is positioned adjacent to the shoulder.

10. The apparatus of claim 1 wherein said sensing means comprises a flow diaphragm.

* * * * *